US010399341B2

(12) United States Patent
Hasegawa

(10) Patent No.: US 10,399,341 B2
(45) Date of Patent: Sep. 3, 2019

(54) INKJET PRINTER

(71) Applicant: Roland DG Corporation, Hamamatsu-shi, Shizuoka (JP)

(72) Inventor: Hideyuki Hasegawa, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/922,948

(22) Filed: Mar. 16, 2018

(65) Prior Publication Data

US 2018/0281417 A1 Oct. 4, 2018

(30) Foreign Application Priority Data

Mar. 31, 2017 (JP) ..... 2017-070625
Jul. 27, 2017 (JP) ..... 2017-145689

(51) Int. Cl.
*B41J 2/165* (2006.01)
*B41J 2/145* (2006.01)

(52) U.S. Cl.
CPC ..... *B41J 2/16508* (2013.01); *B41J 2/145* (2013.01); *B41J 2/16511* (2013.01); *B41J 2/16532* (2013.01); *B41P 2235/27* (2013.01)

(58) Field of Classification Search
CPC .... B41J 2/16511; B41J 2/16505; B41J 29/38; B41J 2/16508; B41J 2/16532; B41J 2/14; B41J 2/1652; B41J 2/145; B41J 2/16517; B41J 2/135; B41J 2/165; B41J 2002/16514; B41J 2/16523; B41J 2/1754
USPC ..... 347/20, 29, 30, 40, 47
See application file for complete search history.

(56) References Cited

U.S. PATENT DOCUMENTS 8,262,193 B2 9/2012 Okazaki et al.

FOREIGN PATENT DOCUMENTS

JP 09-226151 A 9/1997
JP 3480687 B2 12/2003
JP 2010-30061 A 2/2010

*Primary Examiner* — Jannelle M Lebron
(74) *Attorney, Agent, or Firm* — Keating & Bennett, LLP

(57) ABSTRACT

A printer includes a carriage including a main plate, which vertically sandwiches a guide rail and is in a fixed relative vertical positional relationship with the guide rail, and a head plate provided with an ink head, the ink head including a nozzle surface, a cap attachable to and detachable from the ink head and defining a sealed space between the cap and the nozzle surface, and a shifter causing the cap to shift between a capping position and a separated spaced position. When the cap is at the capping position, the cap pushes the ink head upward to a maintenance position.

10 Claims, 11 Drawing Sheets

INKJET PRINTER

CROSS REFERENCE TO RELATED APPLICATIONS

This application claims the benefit of priority to Japanese Patent Application No. 2017-070625 filed on Mar. 31, 2017, and Japanese Patent Application No. 2017-145689 filed on Jul. 27, 2017. The entire contents of these applications are hereby incorporated herein by reference.

BACKGROUND OF THE INVENTION

1. Field of the Invention

The present invention relates to inkjet printers.

2. Description of the Related Art

Inkjet printers are well known to include an ink head having a plurality of nozzles to perform predetermined printing operations on a recording medium by an inkjet technique. Such an inkjet printer is provided with a capping unit for enabling the nozzles to eject ink appropriately. The capping unit has a cap for covering a nozzle surface containing the nozzles when printing is not performed.

The capping unit forms a sealed space by covering the nozzle surface with the cap. By operating a suction pump connected to the capping unit under the condition where the sealed space is formed, ink with an increased viscosity is forcibly sucked out of the nozzles. That is, the ink is forcibly discharged from the nozzles (hereinafter this operation is also called a "suction operation"). This can prevent clogging of the nozzles.

For example, JP 2010-30061 A discloses an inkjet printer in which a nozzle surface is covered by a cap with the nozzle surface being pressed upward by moving the cap upward. In the example shown in JP 2010-30061 A, the cap is attached to the ink head appropriately because a constant force is applied from the cap to the nozzle surface.

In the inkjet printer disclosed in JP 2010-30061 A, the carriage on which the ink head is mounted is configured to be capable of shifting vertically with respect to a first guide member and a second guide member that support the carriage. When performing a printing operation on a recording medium, the carriage is shifted downward to shorten the distance between the ink head and the recording medium. Here, in order to perform high-quality printing, it is necessary to keep the distance constant between the ink head and the recording medium during printing. The carriage that mounts the ink head disclosed in JP 2010-30061 A is, however, not supported on the first guide member and the second guide member in a vertically immovable manner. This means that the carriage can shift vertically relative to the guide rails if vibrations occur in the inkjet printer or the carriage itself moves at high speed during printing. If the carriage can shift vertically, it is impossible to keep the distance constant between the recording medium and the ink head, which is mounted on the carriage, degrading the quality of printing.

SUMMARY OF THE INVENTION

Preferred embodiments of the present invention provide inkjet printers that maintain printing quality and, moreover, do not reduce hermeticity of a sealed space between a cap and a nozzle surface.

An inkjet printer according to a preferred embodiment of the present invention includes an ink head including a nozzle opening, a head plate holding the ink head, and a cap attachable to the ink head to close the nozzle opening, wherein the head plate is elastically deformable, and the cap contacting the ink head to close the nozzle opening causes the head plate to deform.

An inkjet printer according to a preferred embodiment of the present invention includes an ink head including a nozzle opening, a carriage including a main plate and a head plate holding the ink head, a cap attachable to the ink head to close the nozzle opening, and a guide rail along which the carriage moves, wherein the guide rail and the main plate are vertically immovable relative to each other, the guide rail is elastically deformable, the cap contacting the ink head to close the nozzle open in causes the guide rail to deform.

An inkjet printer according to a preferred embodiment of the present invention includes a platen on which a recording medium is to be placed, the platen extending along a main scanning direction, a guide rail disposed above the platen and extending along the main scanning direction, an ink head including a plurality of nozzles to eject ink onto the recording medium and a nozzle surface in which the nozzles are provided, a carriage including a main plate and a head plate, the main plate vertically sandwiching the guide rail and being in a fixed relative vertical positional relationship with the guide rail, the head plate including an opening in which the ink head is fitted, and the carriage provided slidably on the guide rail, a cap attachable to and detachable from the ink head so as to cover the nozzle surface, and defining a sealed space between the cap and the nozzle surface when attached to the ink head, a suction device that sucks fluid from inside the sealed space, and a shifter causing the cap to shift between a capping position, at which the cap covers the nozzle surface, and a separate position, at which the cap is spaced apart from the nozzle surface. When the cap is positioned at the capping position, the cap pushes a portion of the head plate upward with the ink head so that the cap pushes the ink head upward to a maintenance position that is higher than a standard position at which the ink head ejects the ink onto the recording medium.

In inkjet printers according to various preferred embodiments of the present invention, the carriage provided slidably on the guide rail includes the main plate, which is in a fixed relative vertical positional relationship with the guide rail, and the head plate, which includes an opening in which the ink head is fitted. Thus, during printing, the relative vertical positional relationship is kept constant between the ink head and the guide rail, and therefore, the distance between the ink head and the recording medium is kept constant. As a result, it is possible to obtain high-quality printed materials. Moreover, when the cap is at the capping position, the cap pushes a portion of the head plate upward with the ink head, and thus pushes the ink head upward to the maintenance position, which is higher than the standard position. When the cap pushes the ink head upward to the maintenance position, the cap applies a constant or substantially constant force to the ink head. As a result, the cap is attached to the ink head more reliably, and the hermeticity of the sealed space between the cap and the nozzle surface is increased. If the cap is attached and detached repeatedly, the cap or the like can be worn away. Consequently, the fitting of the cap to the ink head may become inadequate, so the hermeticity of the sealed space may become insufficient. However, because the cap pushes the ink head upward to the maintenance position, a constant force is applied from the cap to the ink head even when wearing has occurred in the cap or the like. As a result, the hermeticity of the sealed space will not be reduced.

Preferred embodiments of the present invention make it possible to provide inkjet printers that maintain the quality of printing and, moreover, do not reduce the hermeticity of the sealed space between the cap and the nozzle surface.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinbelow, inkjet printers according to preferred embodiments of the present invention will be described with reference to the drawings. The preferred embodiments described herein are not intended to limit the present invention. The parts and components that exhibit the same effects are denoted by the same reference symbols, and repetitive description thereof may be omitted as appropriate.

First Preferred Embodiment

Figure 1:
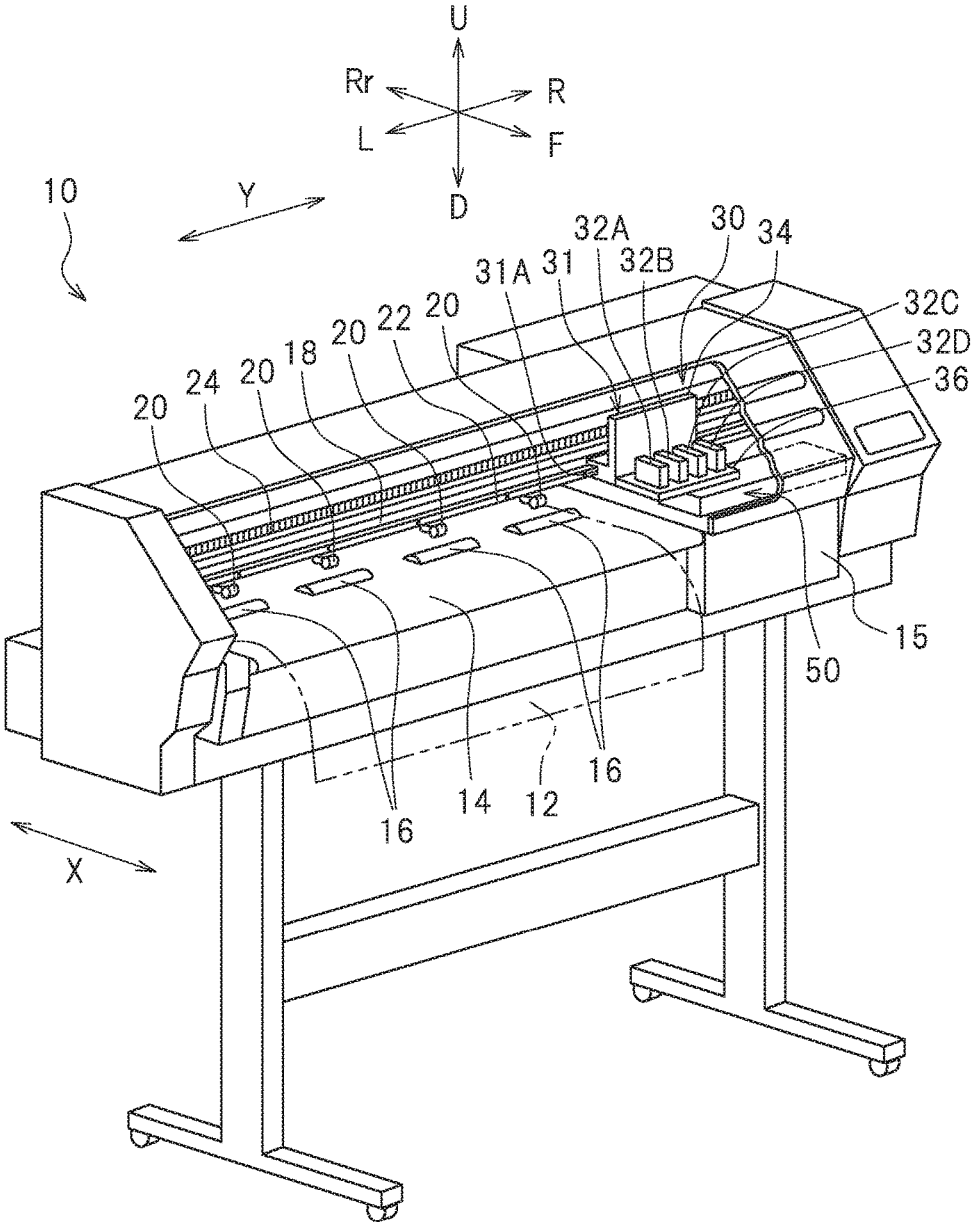
FIG. 1 is a perspective view illustrating an inkjet printer, a portion of which is cut away, according to a preferred embodiment of the present invention.

FIG. 1 is a perspective view illustrating an inkjet printer 10 (hereinafter simply "printer 10"), a portion of which is cut away, according to the present preferred embodiment. As illustrated in FIG. 1, the printer 10 performs printing on a recording medium 12. The recording medium 12 may be, for example, recording paper. The recording medium 12 is, however, not limited to the recording paper. Other than paper materials such as plain paper and printing paper for inkjet printers, examples of the recording medium 12 include sheets and films made of resin such as polyvinyl chloride and polyester, and fabrics such as woven fabric and nonwoven fabric.

In the following description, the terms "left," "right," "up," and "down" respectively refer to left, right, up, and down as defined based on the perspective of the operator facing the printer 10. A direction toward the operator relative to the printer 10 is defined as "frontward," and a direction away from the operator relative to the printer 10 is defined as "rearward." Reference characters F, Rr, L, R, U, and D in the drawings represent front, rear, left, right, up, and down, respectively. Reference character Y in the drawings represents the main scanning direction. In the present preferred embodiment, the main scanning direction Y is a lateral direction, i.e., a left-to-right/right-to-left direction. The main scanning direction Y extends along the width of the recording medium 12. Reference character X in the drawings represents the sub-scanning direction. The sub-scanning direction X is a direction that crosses the main scanning direction Y (for example, a direction perpendicular to the main scanning direction Y in plan view). In the present preferred embodiment, the sub-scanning direction is a front-to-rear/rear-to-front direction. The sub-scanning direction X extends along the length of the recording medium 12. It should be noted, however, that these directional terms are merely provided for convenience in illustration and should not be construed as limiting.

As illustrated in FIG. 1, the printer 10 includes a platen 14 on which the recording medium 12 is to be placed. The platen 14 extends along the main scanning direction Y. The platen is provided with cylindrically shaped grit rollers 16 that define a moving mechanism. The grit rollers 16 are buried in the platen 14 in such a manner that their upper surfaces are exposed. The grit rollers 16 are driven by a feed motor (not shown).

As illustrated in FIG. 1, a guide rail 18 is disposed above the platen 14. The guide rail 18 is disposed parallel or substantially parallel to the platen 14. The guide rail 18 extends along the main scanning direction Y. The guide rail 18 is vertically elastically deformable. For example, a portion of the guide rail 18 that is positioned above later-described caps 51A to 51D (see FIG. 2) may be vertically elastically deformable. It is also possible that the portion of the guide rail 18 that is positioned above the caps 51A to 51D (see FIG. 2) and another portion thereof (for example, a portion thereof that is positioned leftward, or a portion thereof that is positioned rightward, relative to the portion that is positioned above the caps 51A to 51D) may be configured to be vertically elastically deformable. Alternatively, it is possible that the portion of the guide rail 18 that is positioned above the caps 51A to 51D (see FIG. 2) may be vertically elastically deformable and the just-described other portion may be vertically elastically deformable. A plurality of pinch rollers 20 are disposed at regular or substantially regular intervals below the guide rail 18. The pinch rollers 20 are opposed to the grit rollers 16. The pinch rollers 20 are configured in such a manner that their vertical positions are able to be set according to the thickness of the recording medium 12. The recording medium 12 is pinched between the pinch rollers 20 and the grit rollers 16. The grit rollers 16 and the pinch rollers 20 are capable of transporting the recording medium 12 in the sub-scanning directions X while pinching the recording medium 12 therebetween. The guide rail 18 includes an engaging portion 22 protruding frontward.

Figure 2:
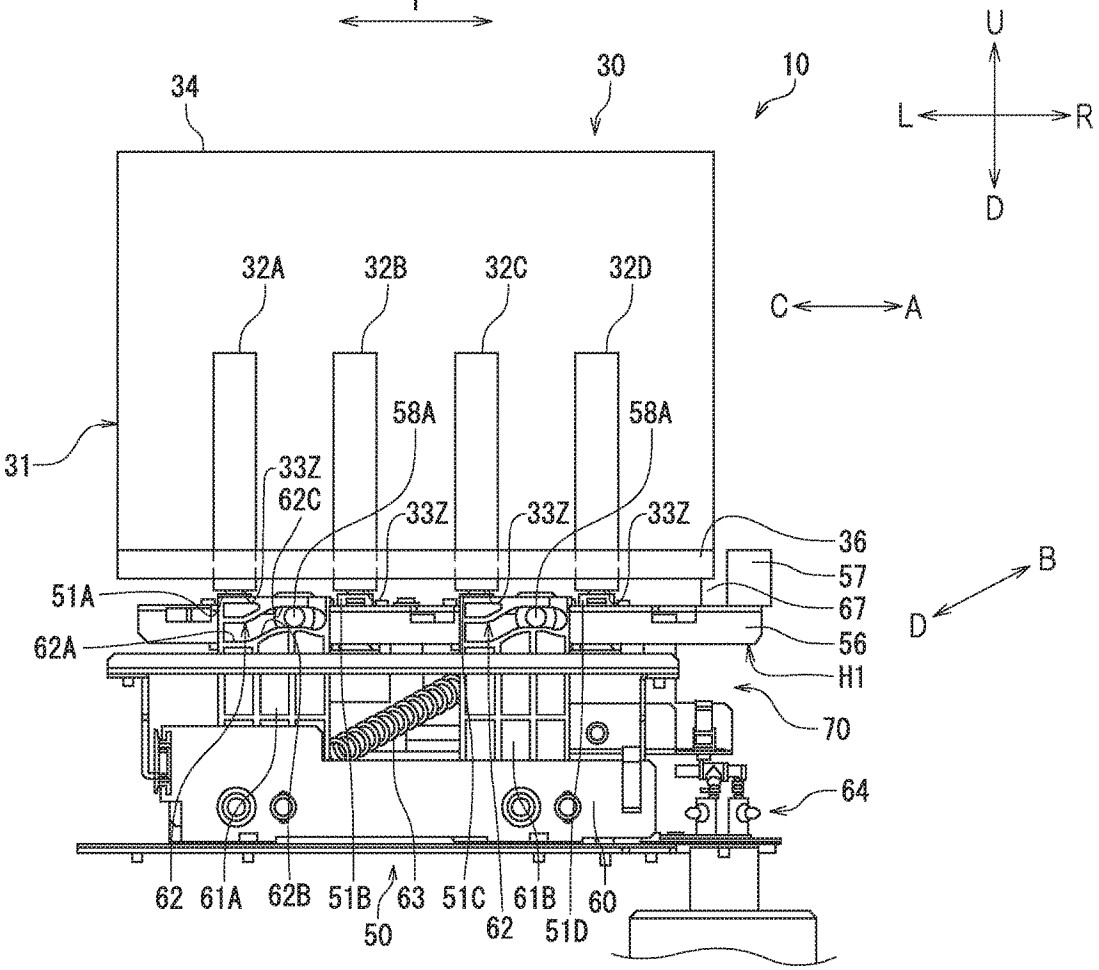
FIG. 2 is a front view illustrating a portion of an inkjet printer according to a preferred embodiment of the present invention.

As illustrated in FIG. 1, the printer 10 includes an ink head unit 30. The ink head unit 30 is disposed above the platen 14. As illustrated in FIG. 2, the ink head unit 30 includes a plurality of ink heads 32A, 32B, 32C, and 32D, and a carriage 31 (see FIG. 1). The plurality of ink heads 32A to 32D are mounted on the carriage 31. The carriage 31 includes a main plate 34 and a head plate 36.

As illustrated in FIG. 1, a recessed portion 31A, which is recessed frontward, is provided in a lower portion of the main plate 34. The engaging portion 22 of the guide rail 18 engages with the recessed portion 31A. The recessed portion 31A vertically sandwiches the engaging portion 22 of the guide rail 18. The main plate 34 is in a fixed relative vertical positional relationship with the guide rail 18. In other words, the main plate 34 does not move upward or downward relative to the guide rail 18. The carriage 31 is movable in the main scanning directions Y along the guide rail 18.

As illustrated in FIG. 1, a portion of a drive belt 24, which extends along the main scanning direction Y, is secured to an upper portion of the main plate 34. The drive belt 24 is a looped endless belt. The drive belt 24 is connected to a scan motor (not shown) and is driven to rotate by the scan motor. As the drive belt 24 travels, the carriage 31 moves in a main scanning direction Y along the guide rail 18. The ink head unit 30 (see FIG. 2) is allowed to be movable in the main scanning directions Y along the guide rail 18 with the carriage 31.

Figure 3:
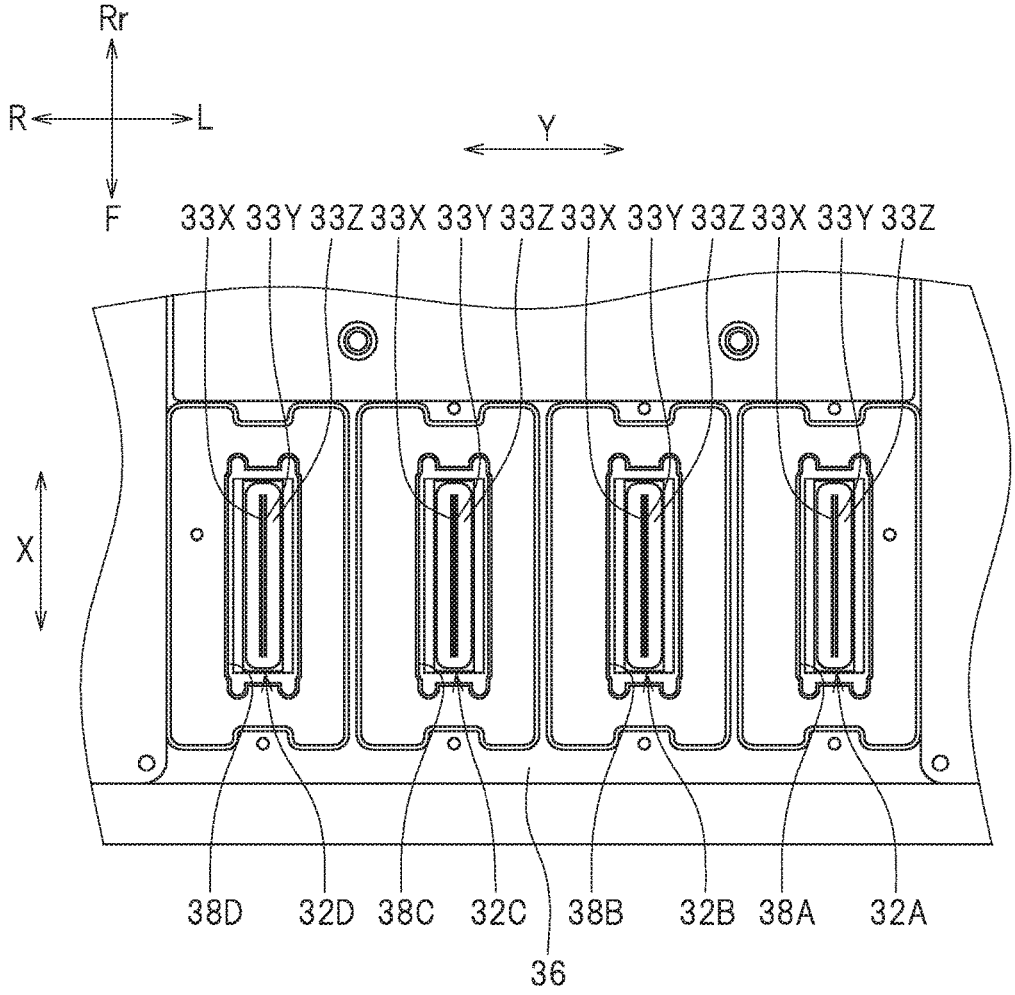
FIG. 3 is a bottom view illustrating an ink head according to a preferred embodiment of the present invention.

As illustrated in FIG. 3, each of the ink heads 32A to 32D preferably has a structure such that its front-to-rear length is longer than its left-to-right length. All the ink heads 32A to 32D preferably have the same or substantially the same shape and dimensions. Each of the ink heads 32A to 32D includes a plurality of first nozzles 33X lined up along the sub-scanning direction X, a plurality of second nozzles 33Y lined up along the sub-scanning direction X, and a nozzle surface 33Z including the first nozzles 33X and the second nozzles 33Y provided therein. The first nozzles 33X and the second nozzles 33Y eject ink onto the recording medium 12. The inside of the first nozzles 33X and the inside of the second nozzles 33Y are set to be a negative pressure (i.e., a pressure lower than the atmospheric pressure). It should be noted that because the first nozzles 33X and the second nozzles 33Y are very small in size, the plurality of first nozzles 33X and the plurality of second nozzles 33Y are depicted by straight lines in FIG. 3. In the present preferred embodiment, each of the ink heads 32A to 32D includes two kinds of nozzles, the first nozzles 33X and the second nozzles 33Y. However, it is also possible that each of the ink heads 32A to 32D may include one kind of nozzles, or may include three or more kinds of nozzles.

The ink heads 32A to 32D are movable with the carriage 31 along the guide rail 18 in the main scanning directions Y. Herein, the vertical position of the ink heads 32A to 32D when the ink heads 32A to 32D move over the platen 14 or a later-described capping unit 50 is defined as a standard position L1 (see FIG. 6). The standard position L1 represents the vertical position of the ink heads 32A to 32D when the ink heads 32A to 32D eject ink onto the recording medium 12. It should be noted that, as will be described later, the caps 51A to 51D push at least a portion of the head plate 36 upward with the ink heads 32A to 32D, such that the ink heads 32A to 32D are pushed upward from the standard position L1 to a maintenance position L2 (see FIG. 6), which is a higher position than the standard position L1. The vertical height difference L3 (see FIG. 6) between the maintenance position L2 and the standard position L1 preferably is, for example, about 0.01 mm to about 1 mm (preferably about 0.1 mm to about 0.3 mm). When the ink heads 32A to 32D are not in contact with the caps 51A to 51D, the ink heads 32A to 32D are positioned at the standard position L1.

As illustrated in FIG. 1, the head plate 36 extends frontward from a lower portion of the main plate 34. The ink heads 32A to 32D are mounted on the head plate 36. As illustrated in FIG. 3, the head plate 36 includes a plurality of openings 38A, 38B, 38C, and 38D, which are lined up along the main scanning direction Y. Each of the openings 38A to 38D preferably has a front-to-rear length longer than a left-to-right length. All the openings 38A to 38D preferably have the same or substantially the same shape and dimensions. The openings 38A to 38D are located at positions that are aligned with respect to the sub-scanning direction X. The ink heads 32A to 32D are fitted respectively in the openings 38A to 38D. When viewed from below, the first nozzles 33X and the second nozzles 33Y are positioned inside each of the openings 38A to 38D. The first nozzles 33X and the second nozzles 33Y are exposed outside through each of the openings 38A to 38D. As illustrated in FIG. 2, the nozzle surfaces 33Z are positioned downward relative to the head plate 36.

As illustrated in FIG. 1, the printer 10 includes a capping unit 50. The capping unit 50 is disposed on a side member 15 positioned to the right of the platen 14. The capping unit 50 is disposed downward relative to the ink head unit 30. The capping unit 50 performs a suction operation. As illustrated in FIG. 2, the capping unit 50 includes a plurality of caps 51, 51B, 51C, and 51D, a shifting table 56, a compressible body 57, a shifting mechanism 70, and a suction pump 64. The shifting table 56 is an example of the shifting body. The suction pump 64 is an example of the suction device. The suction pump 64 sucks out the fluid (such as air or ink) inside a later-described sealed space 50S. The suction pump 64 sucks out the ink contained in the first nozzles 33X (see FIG. 3) and the ink contained in the second nozzles 33Y (see FIG. 3). The suction pump 64 also sucks out the ink contained in the caps 51A to 51D.

Figure 4:
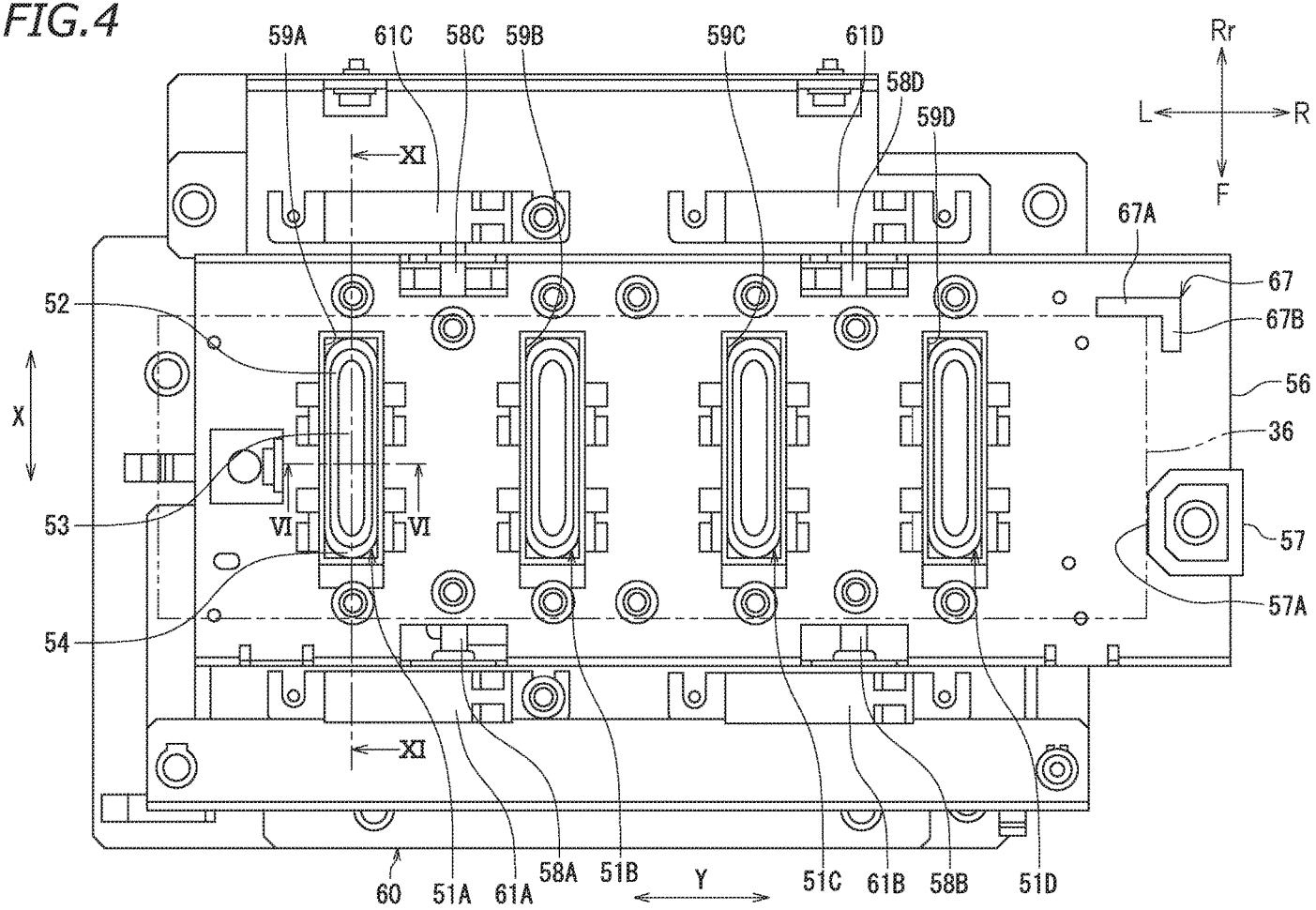
FIG. 4 is a plan view illustrating a capping unit according to a preferred embodiment of the present invention.

As illustrated in FIG. 4, the caps 51A to 51D are provided on the shifting table 56. The caps 51A to 51D are attached respectively to openings 59A to 59D in the shifting table 56. The caps 51A to 51D are lined up along the main scanning direction Y. Each of the caps 51A to 51D preferably has a front-to-rear length longer than a left-to-right length. All the caps 51A to 51D preferably have the same or substantially the same shape and dimensions. The caps 51A to 51D are attachable to and detachable from the respective ink heads 32A to 32D so as to cover the respective nozzle surfaces 33Z (see FIG. 3) of the ink heads 32A to 32D. The phrase "to cover the nozzle surfaces 33Z" means to include cases where at least the first nozzles 33X and the second nozzles 33Y are entirely covered, not just cases where each of the entire nozzle surfaces 33Z is covered. Because the cap 51A has the same structure as those of the caps 51B to 51D, the following description illustrates only the cap 51A.

Figure 5:
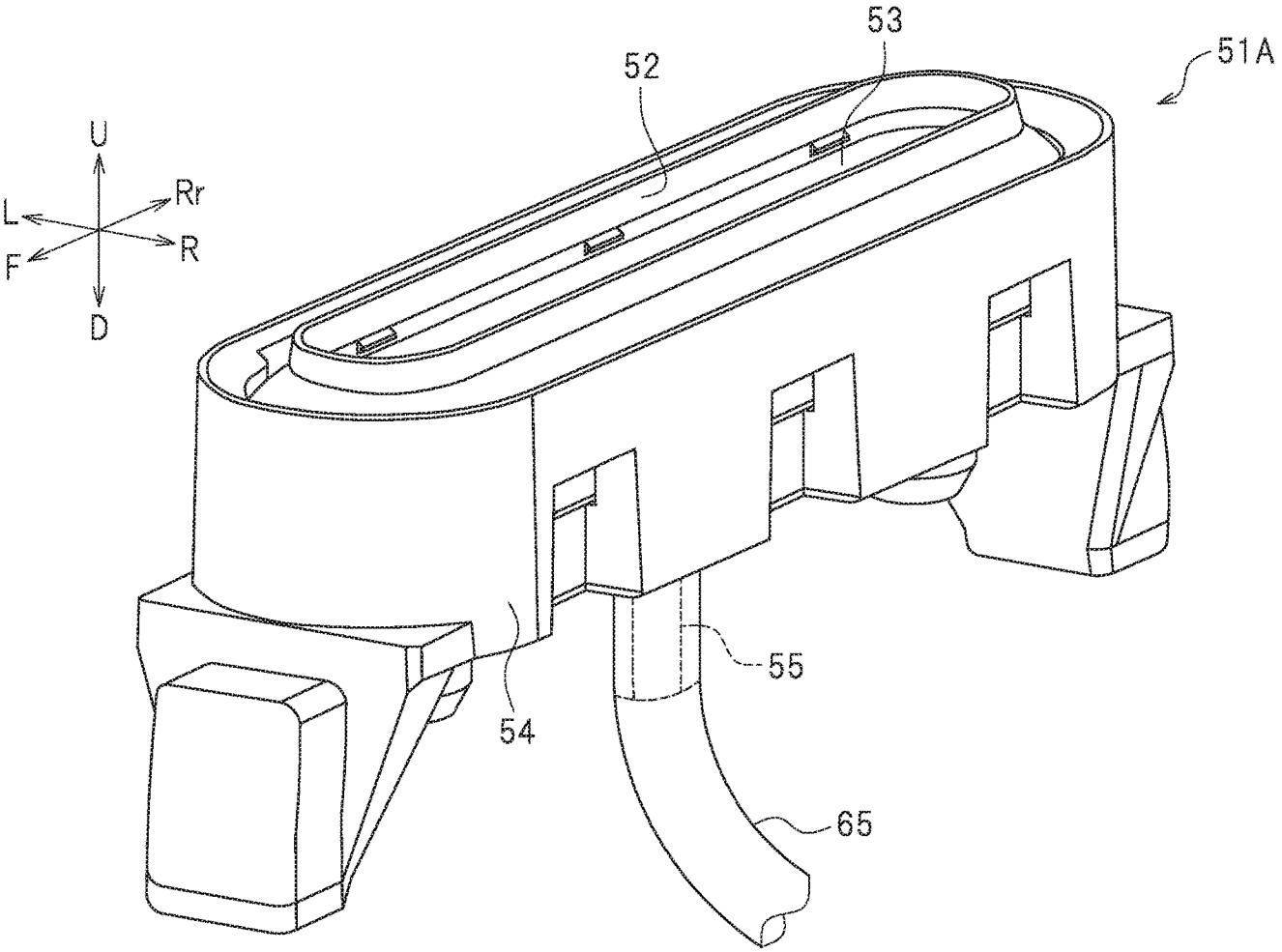
FIG. 5 is a perspective view illustrating a cap according to a preferred embodiment of the present invention.
Figure 6:
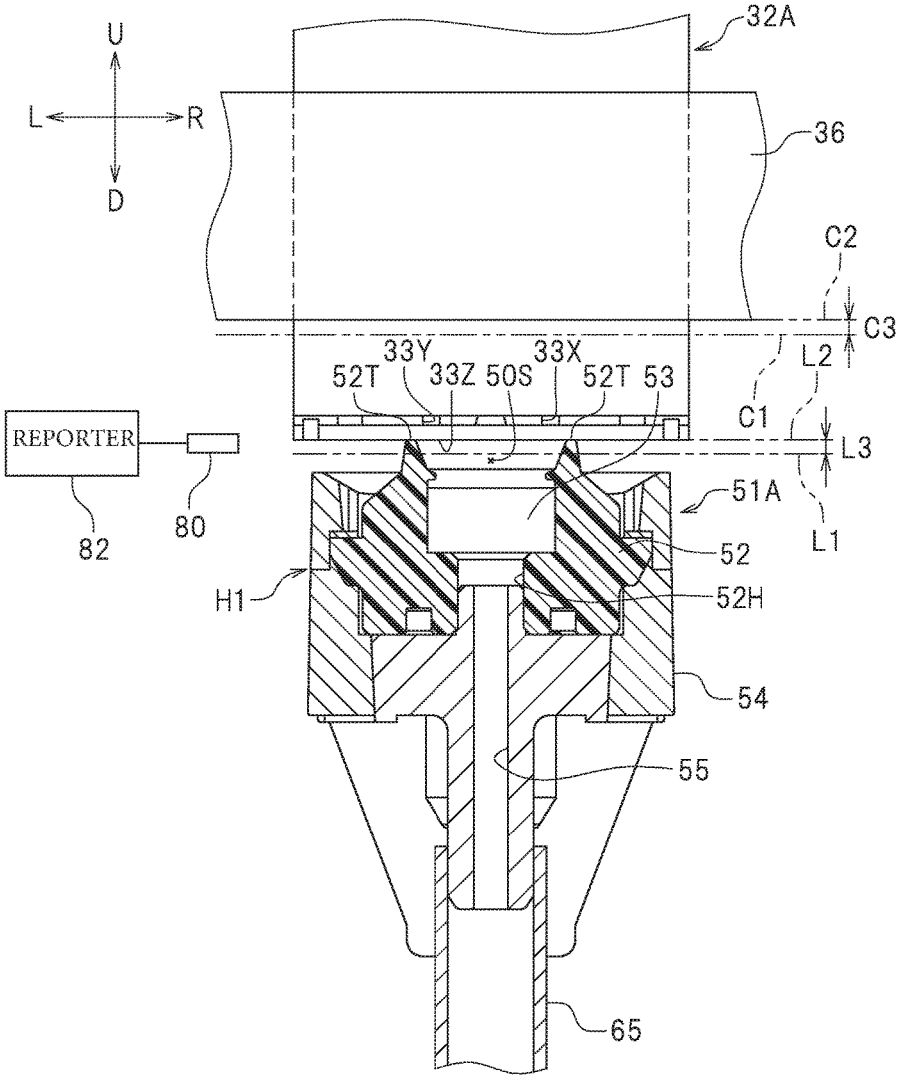
FIG. 6 is a cross-sectional view taken along line VI-VI in FIG. 4, illustrating an ink head that is positioned at a maintenance position.

As illustrated in FIG. 5, the cap 51A includes a lip portion 52, an absorber 53, a main unit case 54, and an ink flow passage 55 (see also FIG. 6). The cap 51A is provided to be attachable to and detachable from the ink head 32A so as to cover the nozzle surface 33Z (see FIG. 3). As illustrated in FIG. 6, a sealed space 50S is provided between the cap 51A and the nozzle surface 33Z when the cap 51A is attached to the ink head 32A.

As illustrated in FIG. 6, the lip portion 52 opens upwardly. The lip portion 52 is disposed inside the main unit case 54. The lip portion 52 is provided in the main unit case 54 so as to be contactable with the nozzle surface 33Z (see FIG. 3). When the lip portion 52 is in contact with to the nozzle surface 33Z, the sealed space 50S is provided between the lip portion 52 and the nozzle surface 33Z. That is, when the cap 51A is at a capping position H1 (see FIG. 2), the lip portion 52 is in contact with the nozzle surface 33Z with the lip portion 52 being compressed by the nozzle surface 33Z. The inside of the sealed space 50S is brought to a pressure lower than the atmospheric pressure by the suction pump 64 sucking the fluid inside the sealed space 50S. The lip portion 52 is preferably made of an elastically deformable material. The lip portion 52 has flexibility. The lip portion 52 is preferably made of rubber, for example. As illustrated in FIG. 4, the lip portion 52 is formed in a frame shape (for example, in an elliptical shape) in plan view. As illustrated in FIG. 6, a through-hole 52H is located in a lower portion of the lip portion 52. The through-hole 52H is in communication with the ink flow passage 55.

As illustrated in FIG. 6, the absorber 53 is disposed inside the lip portion 52. The absorber 53 is disposed upward relative to the through-hole 52H. The absorber 53 is disposed downward relative to a top end 52T of the lip portion 52. The absorber 53 is made of a porous material that is capable of absorbing ink. An example of the absorber 53 is a sponge.

As illustrated in FIG. 6, the ink flow passage 55 is formed in the main unit case 54. The ink flow passage 55 is positioned below the through-hole 52H. The ink flow passage 55 extends vertically. A suction tube 65 is connected to the main unit case 54 of the cap 51A. The suction tube 65 is in communication with the ink flow passage 55. The suction tube 65 is connected to the suction pump 64 (see FIG. 2).

As illustrated in FIG. 2, the suction pump 64 is disposed inside the side member 15 (see FIG. 1). The suction pump 64 is disposed rightward relative to the capping unit 50. The suction pump 64 is connected to the caps 51A to 51D via the suction tube (see FIG. 6). The suction pump 64 sucks the air inside the sealed space 50S (see FIG. 6) so that the ink contained inside the first nozzles 33X and the ink inside the second nozzles 33Y of the ink heads 32A to 32D are discharged out of the first nozzles 33X and the second nozzles 33Y. Thus, the first nozzles 33X and the second nozzles 33Y are prevented from clogging. The ink discharged out of the first nozzles 33X and the second nozzles 33Y is sucked by the suction pump 64 and reserved in a waste ink tank, which is not shown in the drawings. Note that the suction pump 64 sucks out the air contained in the sealed space 50S when the ink heads 32A to 32D are positioned at the maintenance position L2 (see FIG. 6). Here, when the suction pump 64 is carrying out the suction operation, it is preferable that the ink heads 32A to 32D be positioned at the maintenance position L2, but it is also possible that the ink heads 32A to 32D be positioned slightly downward relative to the maintenance position L2 (but upward relative to the standard position L1) due to the elastic restoration force of the guide rail 18 or the head plate 36.

As illustrated in FIG. 2, the shifting mechanism 70 is provided with the shifting table 56. In association with movements of the ink heads 32A to 32D (i.e., the ink head unit 30), the shifting mechanism 70 shifts the shifting table 56 in the main scanning directions Y as well as upward and downward directions. This enables the caps 51A to 51D provided on the shifting table 56 to shift in the main scanning directions Y and in the upward and downward directions, between a capping position H1 (see FIG. 2), at which the caps 51A to 51D respectively cover the nozzle surfaces 33Z, and a separate position H2 (see FIG. 7), at which caps 51A to 51D are spaced apart from the nozzle surfaces 33Z. As will be described later, when the caps 51A to 51D are at the capping position H1, the ink heads 32A to 32D are at the maintenance position L2. The shifting mechanism 70 includes a support base 60 and a spring 63.

The support base 60 is disposed below the shifting table 56. The support base 60 supports the shifting table 56. As illustrated in FIG. 4, the support base 60 includes a plurality of support plates 61A, 61B, 61C, and 61D. The support plates 61A to 61D extend vertically. The support plates 61A and 61B are disposed frontward relative to the shifting table 56. The support plates 61C and 61D are disposed rearward relative to the shifting table 56. As illustrated in FIG. 2, the support plates 61A and 61B are provided with respective guide grooves 62. Each of the guide groove 62 guides the shifting table 56. The guide groove 62 is inclined obliquely upward from the left to the right along the main scanning direction Y. The guide groove 62 includes a first portion 62A extending laterally, a second portion 62B extending obliquely rightward and upward from the right end of the first portion 62A, and a third portion 62C extending rightward from the right end of the second portion 62B. The third portion 62C is positioned upward relative to the first portion 62A. Note that the support plates 61C and 61D, as well as the support plates 61A and 61B, are also provided with respective guide grooves 62.

As illustrated in FIG. 2, the spring 63 is connected to the support base 60 and the shifting table 56. An example of the spring 63 is a tension coil spring. The spring 63 urges the shifting table 56 obliquely leftward and downward.

As illustrated in FIG. 4, the shifting table 56 preferably has a rectangular shape in plan view. The shifting table 56 is provided with a plurality of pins 58A, 58B, 58C, and 58D. The pins 58A to 58D protrude outward from the shifting table 56. The pins 58A and 58B protrude frontward. The pins 58C and 58D protrude rearward. The pins 58A to 58D are respectively inserted into the respective guide grooves 62 of the support plates 61A to 61D. The pins 58A to 58D move within the guide grooves 62.

As illustrated in FIG. 4, the compressible body 57 is capable of shifting integrally with the shifting table 56. The compressible body 57 is an example of the compressible member. The compressible body 57 preferably has a quadrangular prism shape. In the present preferred embodiment, the compressible body 57 is provided on the shifting table 56. The compressible body 57 is disposed rightward relative to the cap 50D. The compressible body 57 is provided at the right end of the shifting table 56. The compressible body 57 is compressible by the ink head unit 30. In the present preferred embodiment, the compressible body 57 is disposed at a position such as to be compressible by the head plate 36 of the carriage 31.

As illustrated in FIG. 4, the shifting table 56 is provided with an abutting piece 67. The abutting piece 67 is capable of shifting integrally with the shifting table 56. The abutting piece 67 preferably has an L-shape. The abutting piece 67 includes a first portion 67A extending along the main scanning direction Y, and a second portion 67B extending along the sub-scanning direction X. The first portion 67A is contactable with the ink head unit 30. In the present preferred embodiment, the first portion 67A is disposed at a position such as to be contactable with the head plate 36. The second portion 67B is positioned rightward relative to a compressible surface 57A of the compressible body 57. Usually, the second portion 67B does not come in contact with the ink head unit 30.

As illustrated in FIG. 6, the printer 10 includes a position detecting sensor 80 to detect that the ink head 32A is positioned at the maintenance position L2 when the cap 51A is at the capping position H1. The position detecting sensor 80 transmits the results of detection to a later-described reporter 82. The printer 10 includes the reporter 82 to report that capping is inadequate if the position detecting sensor 80 does not detect that the ink head 32A is positioned at the maintenance position L2 when the cap 51A is positioned at the capping position H1. Herein, the term "capping" means that the cap 51A has been fitted onto the ink head 32A. The reporter 82 may display the fact that capping is inadequate on a display screen (not shown) provided on the printer 10 by text, or may report the fact that capping is inadequate by sound (for example, warning sound). It should be noted that each of the caps 51B to 51D may also be provided with the position detecting sensor 80 and the reporter 82 that are similar to those described above.

Figure 8:
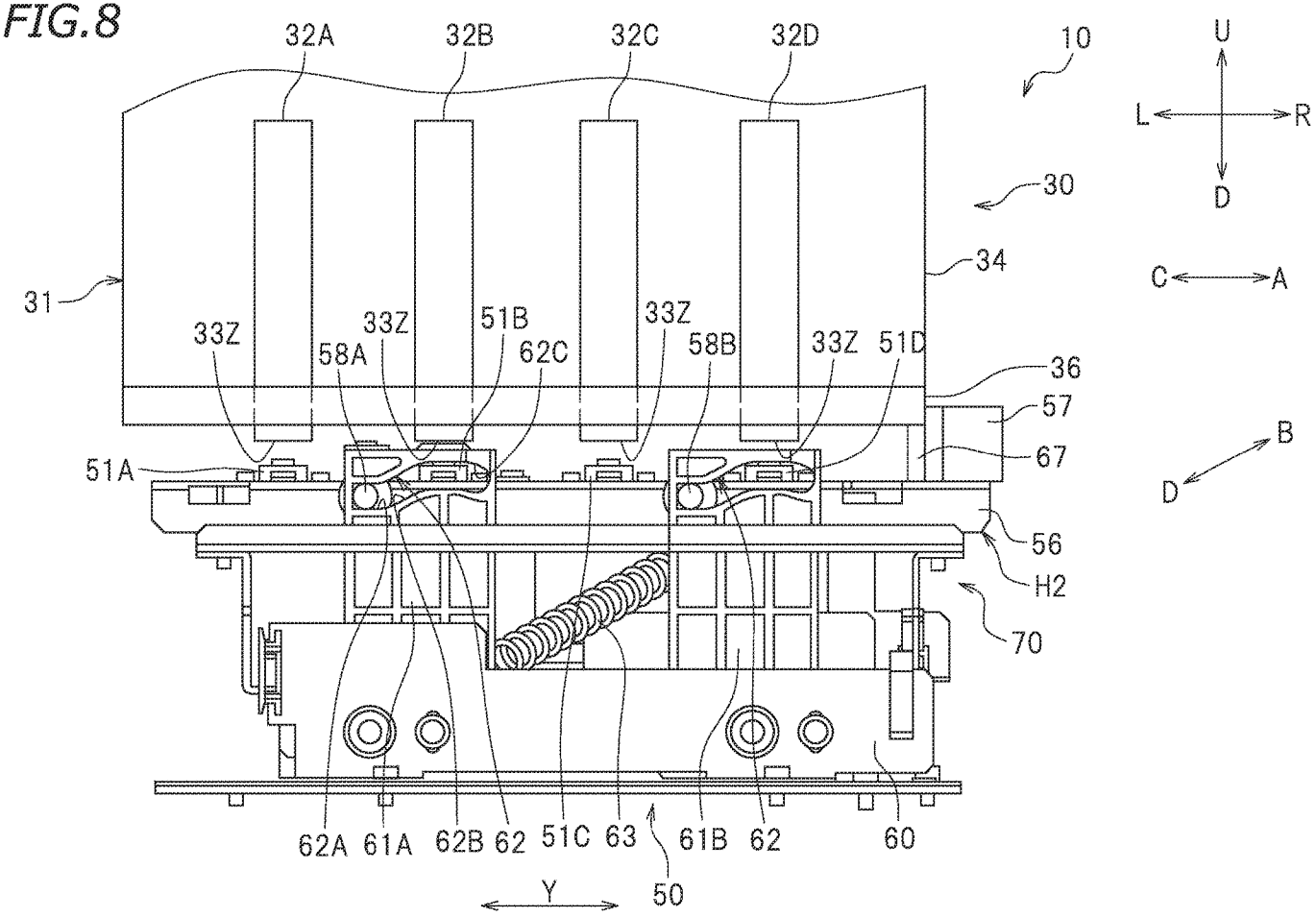
FIG. 8 is a front view illustrating an ink head unit according to a preferred embodiment of the present invention that has come into contact with the compressible body.
Figure 9:
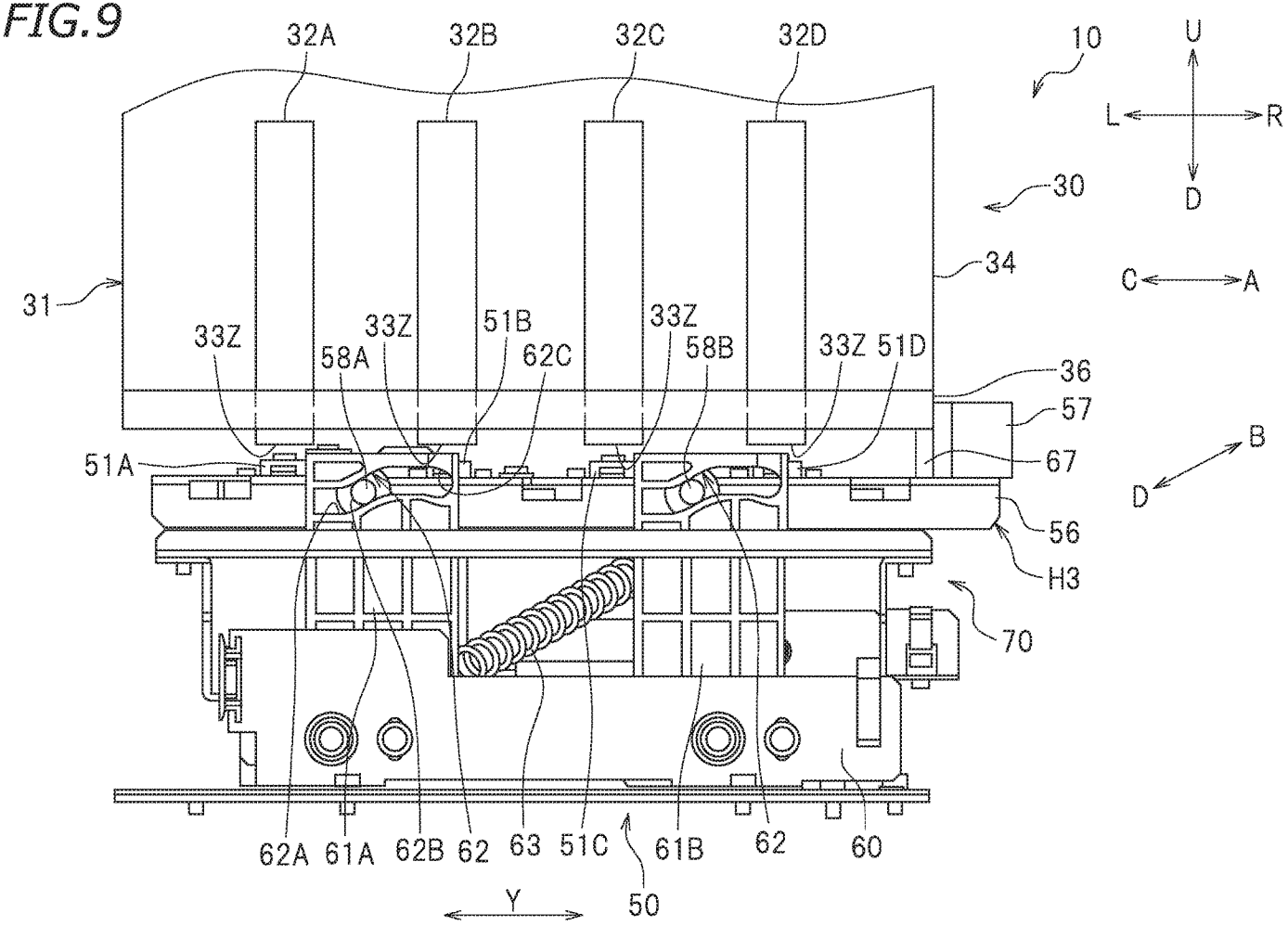
FIG. 9 is a front view illustrating an ink head unit and a compressible body according to a preferred embodiment of the present invention that are sliding against each other.

The shifting table 56 is capable of shifting between the capping position H1 (see FIG. 2) and the separate position H2 (see FIG. 7) in the main scanning directions Y and in the upward and downward directions. The capping position H1 corresponds to a position at which the shifting table 56 is disposed at the highest position (that is, the caps 51A to 51D are disposed at the highest position, see FIG. 2). The separate position H2 corresponds to a position at which the shifting table 56 is disposed at the lowest position (that is, the caps 51A to 51D are disposed at the lowest position, see FIGS. 7 and 8). It should be noted that, herein, a position H3 (see FIG. 9) at which the shifting table 56 is disposed at a position between the position H1 and the position H2 (that is, a position at which the sealed space 50S is not provided) also corresponds to the separate position.

Figure 7:
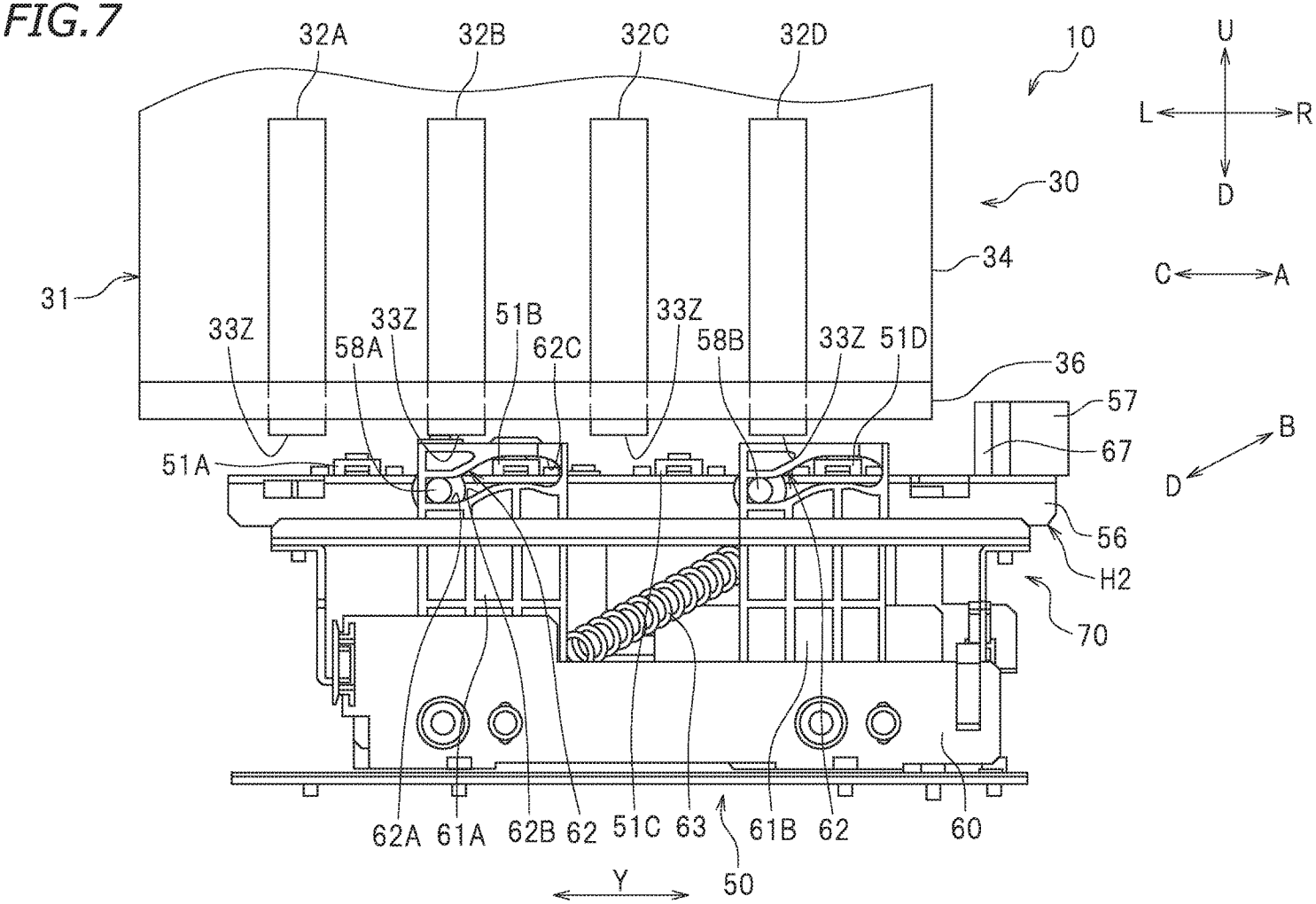
FIG. 7 is a front view illustrating an ink head unit according to a preferred embodiment of the present invention that is moving toward a compressible body.
Figure 10:
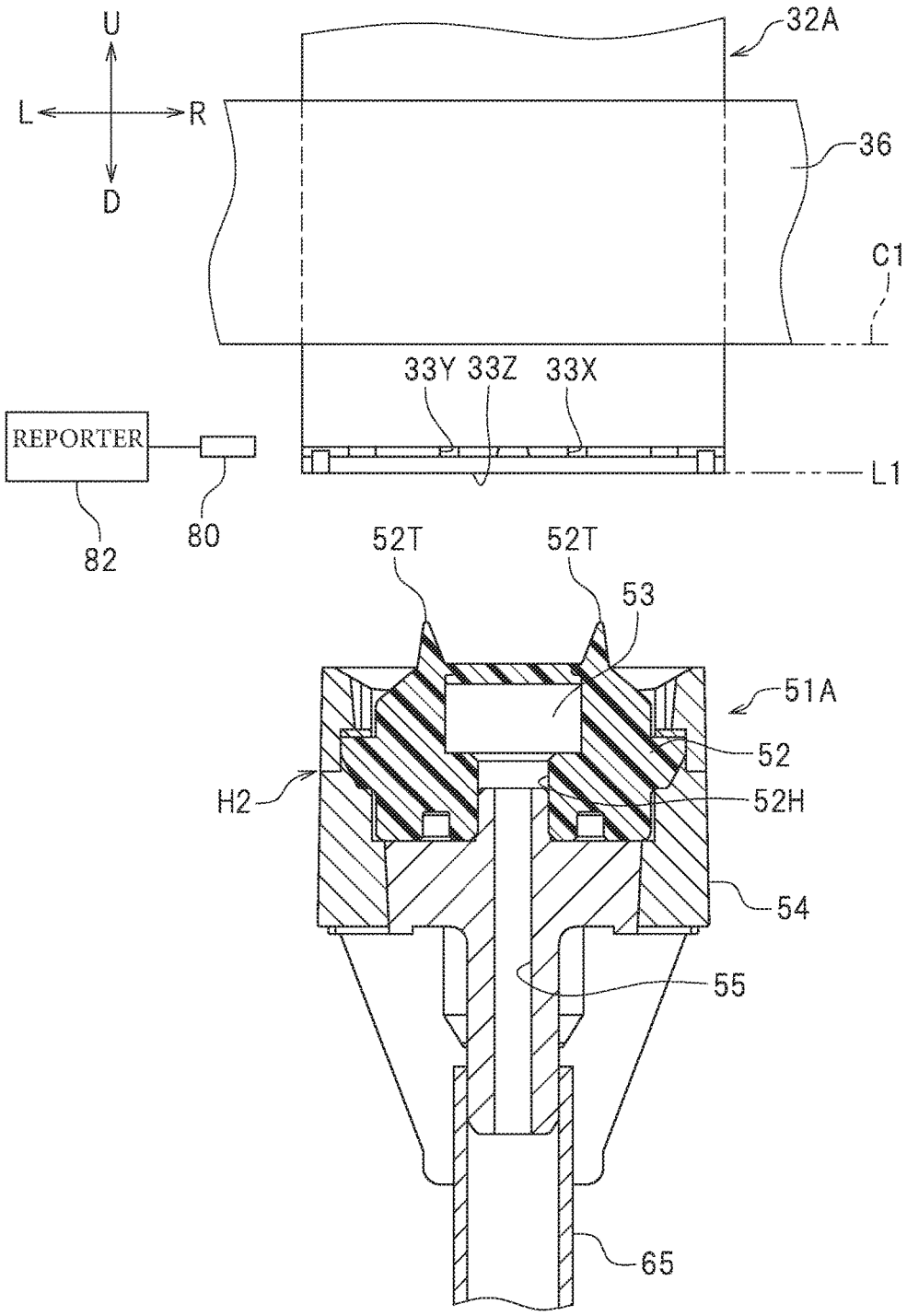
FIG. 10 is a cross-sectional view illustrating an ink head according to a preferred embodiment of the present invention that is positioned at a standard position.

As illustrated in FIG. 7, when the head plate 36 is not pressing the compressible body 57, the shifting table 56 is urged by the spring 63 obliquely leftward and downward, so the shifting table 56 is positioned at the position H2. When the head plate 36 moves rightward (in a direction indicated by the arrow A in FIG. 7) in association with the movement of the carriage 31, the head plate 36 comes into contact with the compressible body 57 (see FIG. 8). At this time, the head plate 36 is in contact with the approximately upper 20% portion of the compressible body 57. When the head plate 36 comes into contact with the compressible body 57, the cap 51A is positioned below the nozzle surface 33Z of the ink head 32A, the cap 51B is positioned below the nozzle surface 33Z of the ink head 32B, the cap 51C is positioned below the nozzle surface 33Z of the ink head 32C, and the cap 51D is positioned below the nozzle surface 33Z of the ink head 32D. The nozzle surfaces 33Z of the ink heads 32A to 32D are not in contact with the caps 51A to 51D. At this time, the ink heads 32A to 32D are positioned at the standard position L1 (see FIG. 10).

Then, when the head plate 36 moves farther rightward, the compressible body 57 moves rightward because the compressible body 57 is pressed by the head plate 36. As a result, the shifting mechanism 70 causes the shifting table 56 to move against the urging force of the spring 63. More specifically, the pins 58A to 58D of the shifting table 56 move from the first portions 62A toward the second portions 62B within the guide grooves 62. As a result, the shifting table 56 moves in a direction indicated by the arrow B in FIG. 8 (obliquely rightward and upward herein), and the shifting table 56 moves to the position H3, which is higher than the position H2 (see FIG. 9). When the shifting table 56 moves from the position H2 to the position H3, the compressible body 57 slides against the head plate 36. This means that the contact area between the head plate 36 and the compressible body 57 gradually increases. Thus, because the compressible body 57 moves upward while the compressible body 57 and the head plate 36 are in contact with each other, abrasion may occur between the compressible body 57 and the head plate 36. At this time, the relative positions between the caps 51A to 51D and the nozzle surfaces 33Z of the ink heads 32A to 32D are not changed with respect to the main scanning direction Y. On the other hand, the relative vertical positions between the caps 51A to 51D and the nozzle surfaces 33Z of the ink heads 32A to 32D are varied. Specifically, the caps 51A to 51D come closer to the nozzle surfaces 33Z, and the gap between the nozzle surfaces 33Z of the ink heads 32A to 32D and the caps 51A to 51D becomes smaller. At this time, the ink heads 32A to 32D are positioned at the standard position L1.

When the head plate 36 moves farther rightward, the head plate 36 pushes the compressible body 57, so the pins 58A to 58D of the shifting table 56 move from the second portions 62B toward the third portions 62C within the guide grooves 62. Consequently, the shifting table 56 moves further in a direction indicated by the arrow B in FIG. 9, so that the shifting table 56 moves to the position H1, which is higher than the position H3. When the shifting table 56 moves to the position H1, in other words, when the caps 51A to 51D are at the capping position H1, the caps 51A to 51D pushes a portion of the head plate 36 from a standard position C1 (see FIG. 6) to a push-up position C2 (see FIG. 6) with the ink heads 32A to 32D, so as to push the ink heads 32A to 32D from the standard position L1 (see FIG. 6) to the maintenance position L2 (see FIG. 6). At this time, as illustrated in FIG. 6, the top end 52T of the lip portion 52 is elastically deformed and compressed. In other words, the top end 52T of the lip portion 52 is compressed by the nozzle surface 33Z. It should be noted that because the ink heads 32A to 32D are secured to the head plate 36, the vertical height difference L3 of the ink heads 32A to 32D between the maintenance position L2 and the standard position L1 is equal to the vertical height difference C3 of the head plate 36 between the push-up position C2 and the standard position C1 when the guide rail 18 is not shifted upward. Here, the total force P1 that is applied from the caps 51A to 51D through the ink heads 32A to 32D to the head plate 36 (that is, the force that pushes the head plate 36 upward) is greater than the gravitational force P2 acting on the entirety of the carriage 31, which includes the ink heads 32A to 32D and the head plate 36. For example, $P1 \geq 1.1P2$ (preferably $P1 \geq 1.5P2$). In this way, the caps 51A to 51D are attached respectively onto the ink heads 32A to 32D, and the sealed spaces 50S (see FIG. 6) are provided between the caps 51A to 51D and the nozzle surfaces 33Z. At the time when the sealed space 50S is formed, the head plate 36 is in contact with the approximately upper 50% portion of the compressible body 57. At this time, the relative positions between the nozzle surfaces 33Z of the ink heads 32A to 32D and the caps 51A to 51D are unvaried with respect to the main scanning direction Y, but the relative positions between the nozzle surfaces 33Z of the ink heads 32A to 32D and the caps 51A to 51D are varied with respect to the vertical direction. For this reason, the caps 51A to 51D do not slide against the nozzle surfaces. Thus, when the caps 51A to 51D move from the separate position (the position H2) to the capping position (the position H1), wearing can occur only between the compressible body 57 and the head plate 36.

When the head plate 36 moves leftward (in a direction indicated by the arrow C in FIG. 2) from the state in which the shifting table 56 is positioned at the position H1, the pins 58A to 58D of the shifting table 56 move from the third portions 62C toward the first portions 62A within the guide grooves 62. As a result, the shifting table 56 moves in a direction indicated by the arrow D in FIG. 2 (obliquely leftward and downward herein), that is, the shifting table 56 moves from the position H1 to the position H2, so that the caps 51A to 51D are detached respectively from the ink heads 32A to 32D. Thus, the head plate 36 moves from the push-up position C2 to the standard position C1. Accordingly, the ink heads 32A to 32D move from the maintenance position L2 to the standard position L1. Note that during the time between the time immediately before the head plate 36 starts pressing the compressible body 57 and the time immediately after the head plate 36 finishes pressing the compressible body 57, the nozzle surfaces 33Z of the ink heads 32A to 32D are positioned respectively above the caps 51A to 51D. In other words, the relative positions between the nozzle surfaces 33Z of the ink heads 32A to 32D and the caps 51A to 51D are not changed with respect to the main scanning direction Y.

As thus far described, in the printer 10 according to the present preferred embodiment, the carriage 31 provided slidably on the guide rail 18 includes the main plate 34, which is in a fixed relative vertical positional relationship with the guide rail 18, and the head plate 36, which includes openings 38A to 38D in which the ink heads 32A to 32D are fitted. Accordingly, during printing, the relative vertical positional relationship is kept constant between the ink heads 32A to 32D and the guide rail 18, and therefore, the distance between the ink heads 32A to 32D and the recording medium 12 is able to be kept constant. As a result, it is possible to obtain high-quality printed materials. Moreover, when the caps 51A to 51D are at the capping position H1, the caps 51A to 51D push a portion of the head plate 36 upward with the ink heads 32A to 32D and push the ink heads 32A to 32D upward to the maintenance position L2, which is higher than the standard position L1. When the caps 51A to 51D push the ink heads 32A to 32D upward to the maintenance position L2, the caps 51A to 51D apply a constant force to the ink heads 32A to 32D. As a result, the caps 51A to 51D are attached to the ink heads 32A to 32D more reliably, and the hermeticity of the sealed spaces 50S between the caps 51A to 51D and the nozzle surfaces 33Z is increased. If the caps 51A to 51D are attached and detached repeatedly, the caps 51A to 51D or the like can be worn away. Consequently, the fitting of the caps 51A to 51D to the ink heads 32A to 32D may become inadequate, and variations may occur in the hermeticity of the sealed spaces 50S. However, because the caps 51A to 51D push the ink heads 32A to 32D upward to the maintenance position L2, a constant force is applied to the ink heads 32A to 32D even when wearing has occurred in the caps 51A to 51D or the like. As a result, the hermeticity of the sealed space 50S is maintained.

In the printer 10 according to the present preferred embodiment, the head plate 36 is vertically elastically deformable. This enables the caps 51A to 51D to easily push a portion of the head plate 36 upward with the ink heads 32A to 32D.

In the printer 10 according to the present preferred embodiment, the lip portion 52 is preferably made of an elastically deformable material. This prevents the lip portion 52 from applying an excessive force to each of the ink heads 32A to 32D. Moreover, because the lip portion 52 is in contact with the nozzle surface 33Z with the lip portion 52 being compressed by the nozzle surface 33Z, adhesion between the lip portion 52 and the nozzle surface 33Z is enhanced, and the hermeticity of the sealed space 50S is increased.

In the printer 10 according to the present preferred embodiment, the shifting mechanism 70 causes the shifting table 56 provided with the caps 51A to 51D to shift along the main scanning direction Y and along upward and downward directions, to shift the caps 51A to 51D between the capping position H1 and the separate position H2. Because the caps 51A to 51D are able to be shifted by shifting the shifting table 56, the mechanism to shift the caps 51A to 51D is simplified, especially in cases where the printer 10 is furnished with a plurality of ink heads 32A to 32D and a plurality of caps 51A to 51D.

In the printer 10 according to the present preferred embodiment, the compressible body 57 is pressed by the head plate 36 of the carriage 31, such that the shifting table 56 is guided to the guide grooves 62, and the caps 51A to 51D are shifted from the separate position H2 to the capping position H1. Thus, the shifting table 56 provided with the caps 51A to 51D is able to be shifted and a portion of the head plate 36 can also be pushed upward using a single power source (scan motor) to move the carriage 31. Moreover, the power source has a relatively high driving power, so the head plate 36 on which the ink heads 32A to 32D are mounted is able to be shifted upward easily.

In order to further enhance adhesion between the caps 51A to 51D and the ink heads 32A to 32D (i.e., in order to further increase the hermeticity of the sealed spaces 50S), the printer 10 may be furnished with an elastic body that urges the ink heads 32A to 32D toward the caps 51A to 51D, against the total force P applied from the caps 51A to 51D through the ink heads 32A to 32D to the head plate 36. An example of the elastic body is a spring. The elastic body urges the ink heads 32A to 32D downwardly. The elastic body may directly come in contact with the ink heads 32A to 32D to urge the ink heads 32A to 32D toward the caps 51A to 51D. The elastic body may directly come in contact with the carriage 31 to indirectly urge the caps 51A to 51D toward the ink heads 32A to 32D.

Figure 11:
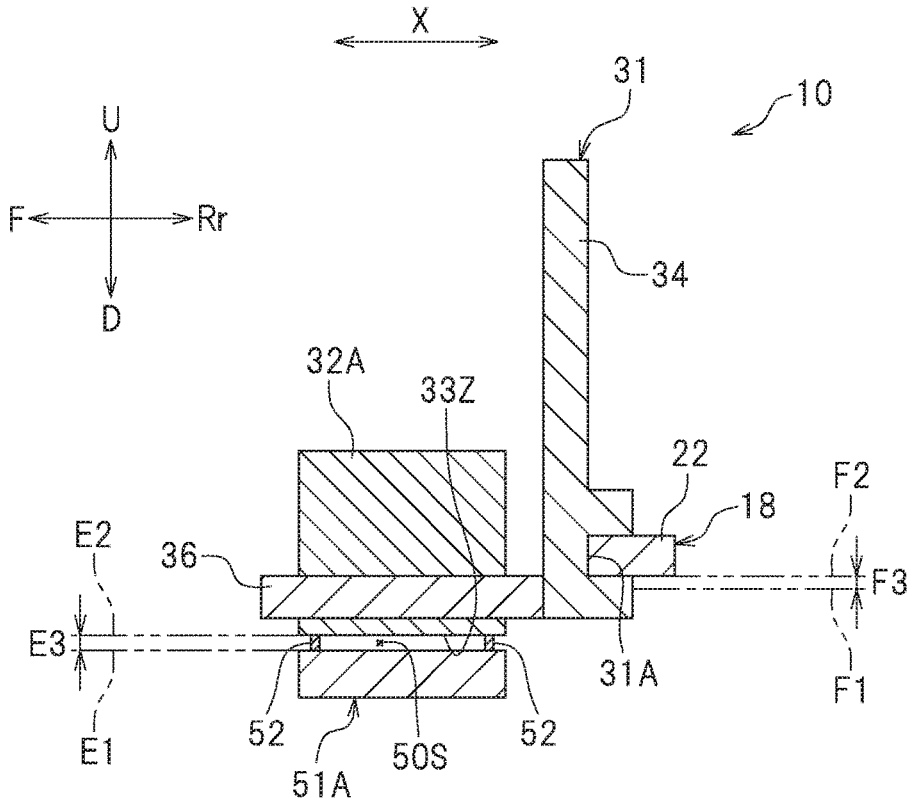
FIG. 11 is a view corresponding to a cross-sectional view taken along line XI-XI in FIG. 4, illustrating an ink head according to a second preferred embodiment of the present invention that is positioned at a maintenance position.

FIG. 11 is a cross-sectional view illustrating the ink head 32A according to a second preferred embodiment of the present invention that is positioned at a maintenance position E2. In the present preferred embodiment, as illustrated in FIG. 11, the caps 51A to 51D push at least a portion of the guide rail 18 upward with the ink heads 32A to 32D, such that the ink heads 32A to 32D are pushed upward from a standard position E1 to a maintenance position E2, which is a higher position than the standard position E1. The force that pushes the caps 51A to 51D upward is transmitted to the ink heads 32A to 32D, the head plate 36, and the recessed portion 31A of the main plate 34. The vertical height difference E3 between the maintenance position E2 and the standard position E1 is, for example, about 0.01 mm to about 1 mm (preferably about 0.1 mm to about 0.3 mm). When the ink heads 32A to 32D are not in contact with the caps 51A to 51D, the ink heads 32A to 32D are positioned at the standard position E1.

When the shifting table 56 moves to the position H1 (see FIG. 2), in other words, when the caps 51A to 51D are at the capping position H1, the caps 51A to 51D pushes a portion of the guide rail 18 from a standard position F1 (see FIG. 11) to a push-up position F2 (see FIG. 11) with the ink heads 32A to 32D, so as to push the ink heads 32A to 32D from the standard position E1 (see FIG. 11) to the maintenance position E2 (see FIG. 11). It should be noted that because the ink heads 32A to 32D are secured to the head plate 36, the vertical height difference E3 of the ink heads 32A to 32D between the maintenance position E2 and the standard position E1 is equal to the vertical height difference F3 of the guide rail 18 between the push-up position F2 and the standard position F1 when the head plate 36 is not shifted upward.

With the printer 10 according to the present preferred embodiment, when the caps 51A to 51D are at the capping position H1, the caps 51A to 51D push a portion of the guide rail 18 upward with the ink heads 32A to 32D and push the ink heads 32A to 32D upward to the maintenance position E2. Thus, a portion of the guide rail 18 is able to be pushed upward by the force that pushes the caps 51A to 51D upward, so that the ink heads 32A to 32D can be pushed upward to the maintenance position E2, which is higher than the standard position E1. At this time, a constant force is applied from the caps 51A to 51D to the ink heads 32A to 32D. Therefore, the caps 51A to 51D are attached to the ink heads 32A to 32D more reliably, and the hermeticity of the sealed spaces 50S between the caps 51A to 51D and the nozzle surfaces 33Z is increased.

In the printer 10 according to the present preferred embodiment, the guide rail 18 is vertically elastically deformable. For example, at least a portion of the guide rail 18 that is positioned above the caps 51A to 51D is vertically elastically deformable. This enables the caps 51A to 51D to easily push a portion of the guide rail 18 upward with the ink heads 32A to 32D.

In the printer 10 according to the present preferred embodiment, the head plate 36 is vertically elastically deformable. This enables the caps 51A to 51D to push a portion of the guide rail 18 and a portion of the head plate 36 upward with the ink heads 32A to 32D easily.

Hereinabove, preferred embodiments of the present invention have been described. It should be noted, however, that the foregoing preferred embodiments are merely exemplary and the present invention may be embodied in various other forms.

In the foregoing preferred embodiments, the shifting mechanism 70 preferably causes the shifting table 56 in the main scanning directions Y and the upward and downward directions, but this is merely illustrative. The shifting mechanism 70 may also cause the shifting table 56 only in the upward and downward directions. The shifting mechanism 70 may also cause the shifting table 56 in the main scanning directions Y, in the upward and downward directions, and in the sub-scanning directions X.

In the foregoing preferred embodiments, the printer 10 preferably includes the platen 14 on which the recording medium 12 is to be placed and to cause that recording medium 12 to be transferred by the grit rollers 16 in a sub-scanning direction X, but this is merely illustrative. For example, the printer 10 may also be a so-called flat-bed printer. Specifically, the printer 10 may be provided with a table capable of moving the recording medium 12 in the main scanning directions Y and sub-scanning directions X.

In the foregoing preferred embodiments, it is possible to use a configuration in which the caps 51A to 51D may push a portion of the head plate 36 and a portion of the guide rail 18 upward with the ink heads 32A to 32D, to push the ink heads 32A to 32D upward to the maintenance position L2 (E2).

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inkjet printer, comprising:
an ink head including a nozzle opening;
a carriage including a head plate holding the ink head;
a guide rail along which the carriage moves; and
a cap attachable to the ink head to close the nozzle opening; wherein
the head plate is elastically deformable;
the cap contacting the ink head to close the nozzle opening causes the head plate to deform.

2. The inkjet printer according to claim 1, wherein the head plate deforms in a direction that is opposite to a gravitational direction.

3. The inkjet printer according to claim 1, wherein the head plate and the ink head are fixed to each other.

4. The inkjet printer according to claim 1, wherein the head plate deforms at one portion thereof.

5. The inkjet printer according to claim 1, wherein the cap contacting the ink head to close the nozzle opening pushes a portion of the ink head in a direction that is opposite to a gravitational direction.

6. The inkjet printer according to claim 1, wherein the cap contacting the ink head to close the nozzle opening pushes a portion of a guide rail in a direction that is opposite to a gravitational direction.

7. The inkjet printer according to claim 1, wherein:
the carriage includes a main plate; and
the guide rail and the main plate are vertically immovable relative to each other.

8. The inkjet printer according to claim 7, wherein the cap contacting the ink head to close the nozzle opening pushes a portion of the guide rail in a direction that is opposite to a gravitational direction.

9. The inkjet printer according to claim 8, wherein the cap contacting the ink head to close the nozzle opening pushes a portion of the head plate in the direction that is opposite to the gravitational direction.

10. The inkjet printer according to claim 8, wherein the head plate includes a first portion and a second portion, the first portion of the head plate is fixed to a portion of the main plate, and the second portion of the head plate deforms when the cap contacts the ink head to close the nozzle opening.

* * * * *